United States Patent [19]

Mills

[11] 3,992,729

[45] Nov. 23, 1976

[54] CARRIER OR SUPPORT MEANS FOR DISPOSABLE BEDPANS

[76] Inventor: Kenneth Wilson Mills, 11 Redcar Road, Smithills Dean, Bolton, Lancashire, BL1 2HP, England

[22] Filed: Apr. 14, 1975

[21] Appl. No.: 567,997

[52] U.S. Cl. ..... 4/110

[51] Int. Cl.[2] ..... A47K 11/02; E03D 13/00

[58] Field of Search ..... 4/112, 113, 111, 110, 4/142, 1

[56] References Cited

UNITED STATES PATENTS

| | | | |
|---|---|---|---|
| 3,069,693 | 12/1962 | Brodsky | 4/112 |
| 3,249,950 | 5/1966 | Wilson | 4/112 |
| 3,319,263 | 5/1967 | Udden et al. | 4/112 |
| 3,377,631 | 4/1968 | Whitney | 4/112 |
| 3,460,164 | 8/1969 | Patton | 4/112 |
| 3,597,771 | 8/1971 | Rickmeier, Jr. | 4/112 |
| 3,713,178 | 1/1973 | Mallette | 4/112 |
| 3,771,493 | 11/1973 | Chandor | 4/112 X |

*Primary Examiner*—Henry K. Artis
*Attorney, Agent, or Firm*—Ulle C. Linton

[57] ABSTRACT

This invention provides a non-expendable support or carrier for a disposable bedpan and broadly comprises a center portion shaped to receive the receptacle portion of a bedpan, a web adapted to fit below and support the conventional seat part of the bedpan, and extending from said web a downwardly and outwardly extending flange which for the major part of its circumference is only about half the depth of the dished part. At opposite sides and rearwardly of the support's transverse center line said flange is formed with wing portions which extend downwardly and outwardly to or almost to the base of the dished part. The extremities of said wing portions preferably are widened or flanged to provide broad smooth bearing surfaces.

4 Claims, 7 Drawing Figures

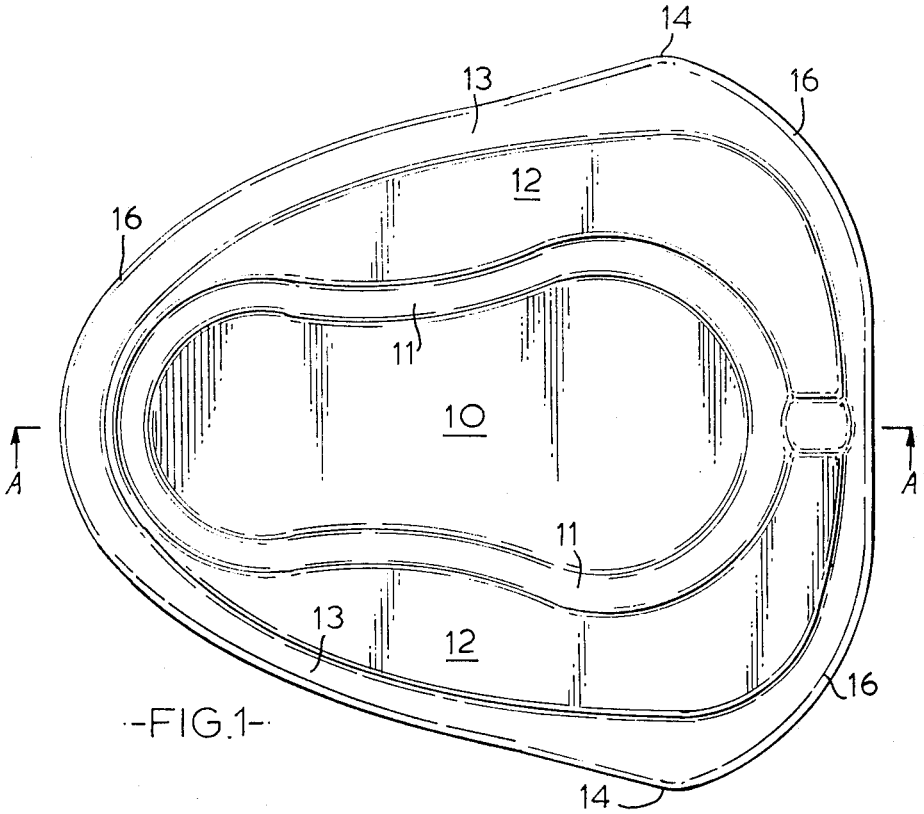
-FIG.1-
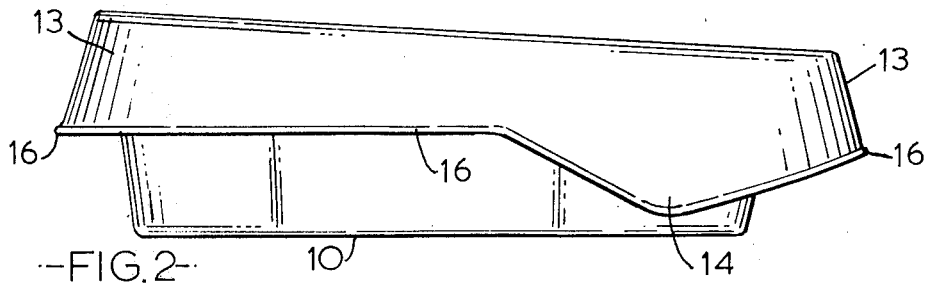
-FIG.2-
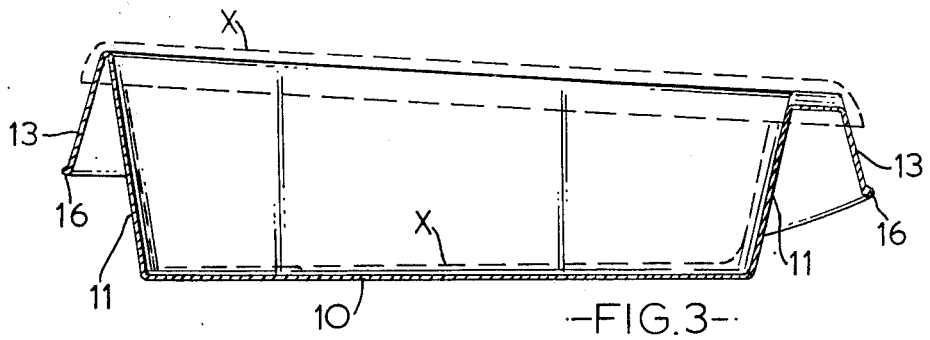
-FIG.3-

--FIG. 4--
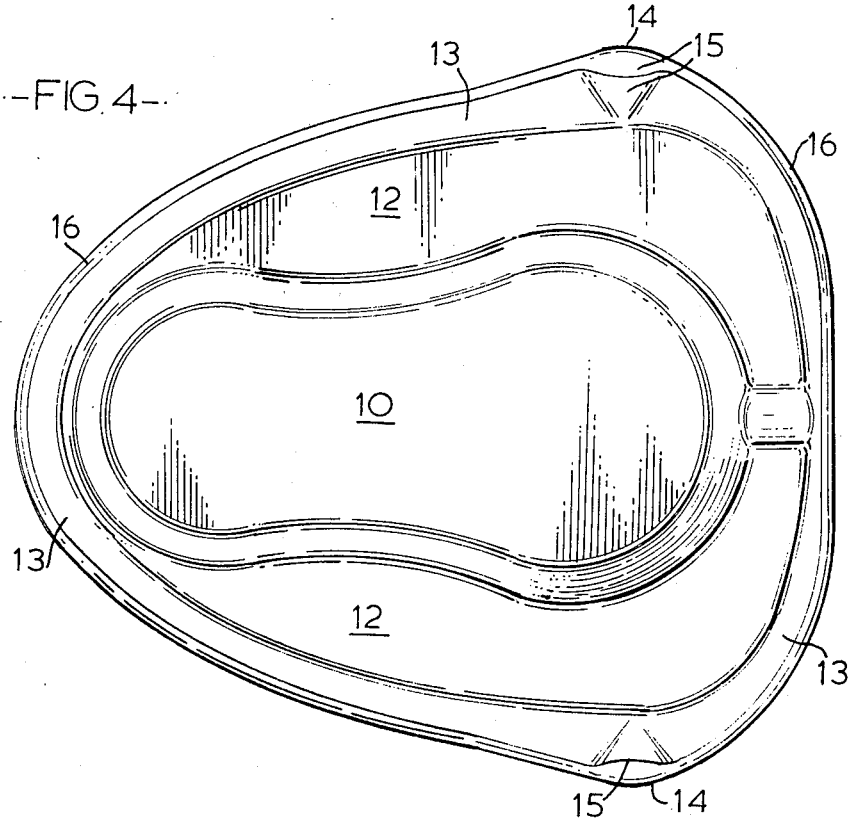
--FIG. 5--
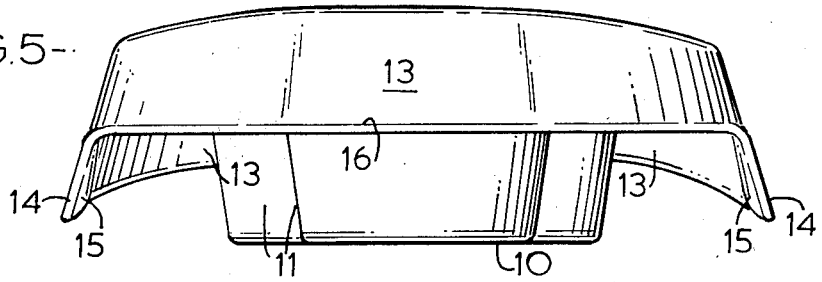
--FIG. 6--
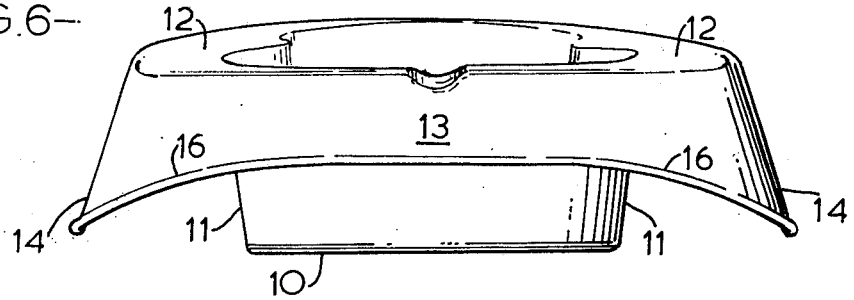

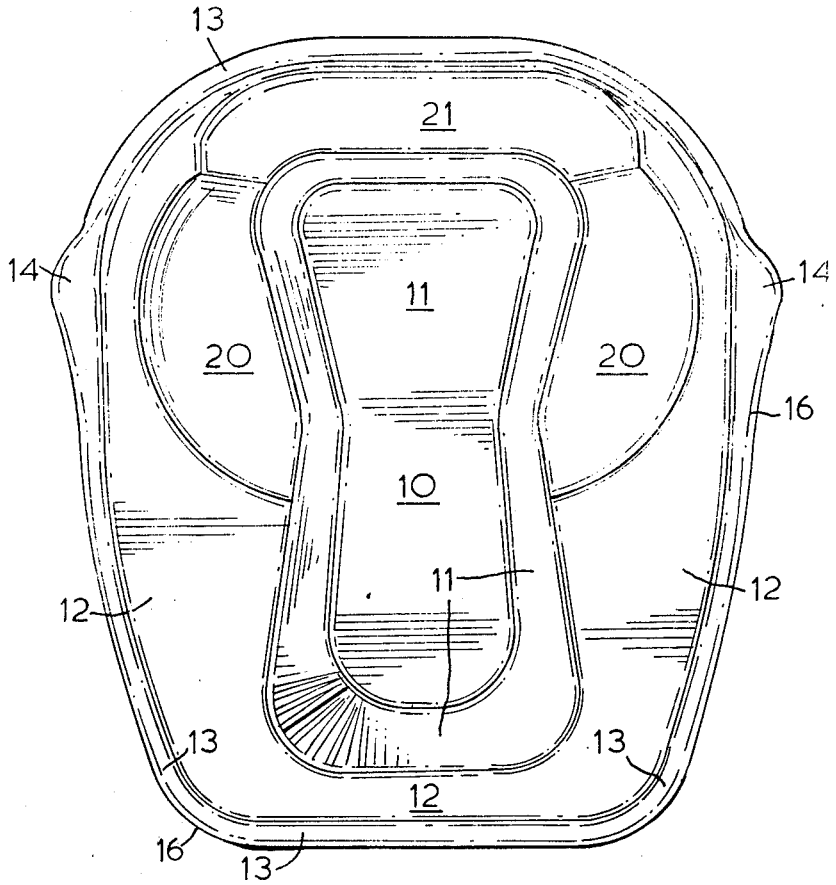
-FIG.7-

CARRIER OR SUPPORT MEANS FOR DISPOSABLE BEDPANS

This invention is concerned with disposable bedpans of the kind which are moulded or pressed from a fibrous e.g. cellulose pulp or paper and which are intended for disposal in a convenient and hygenic manner as by means of waste disposal apparatus wherein, together with their contents, they are disintegrated or pulverised and discharged into a normal drainage system.

Such disposable bedpans are not by themselves intended to sustain, or be capable of sustaining, the weight of a user, and conventionally are inserted in complementary non-expendable carrier or support means which may be composed of a rigid synthetic resin or any other suitable material.

Non-expendable carriers or supports as conventionally manufactured are reasonably satisfactory in use, but nevertheless have disadvantages. For example conventional carriers or supports usually have an all round outwardly and downwardly extending skirt which terminates level with the base and is intended to impart stability to the article in use. However such a skirt tends to render difficult the sliding of the support into a position of use. Further, said skirt tends to trap, and may cause injury to, the fingers of a user thus rendering handling difficult. Yet further, the lower edges of such a skirt tend to abrade and shorten the life of bed linen. It is the object of the present invention to provide an improved form of carrier or support which obviates the above disadvantages.

Broadly, according to the present invention, a non-expendable support or carrier for a disposable bedpan comprises a dished centre portion defined by a substantially flat bottom, generally outwardly inclined side walls and an upper web where from extends downwardly and outwardly a peripheral flange the major part of the circumference whereof extends for substantially less than the depth of said dished centre part, said flange at each side and rearwardly of the transverse centre line of the support being formed with downwardly and outwardly extending wing portions the extremities whereof are substantially on a level with the bottom of said dished centre part. The dished centre portion is shaped to receive the receptacle portion of the bedpan, and the web is adapted to fit below and support the conventional seat part or flange of a said bedpan. Preferably said peripheral flange is provided with a continuous all round beading. Said wing portions may be substantially thicker or be flanged or widened thereby to provide broad smooth bearing surfaces designed so as to minimise the damaging of any supporting surface.

A bedpan support or carrier constructed in accordance with the invention is stable in use, can readily be manipulated without any risk of the fingers becoming trapped, and can easily be slid into required position without danger of damaging bed linen.

The invention is further described with the aid of the accompanying drawing which illustrate by way of example only, two embodiments.

In said drawings:

FIG. 1 is a plan view,

FIG. 2 a side elevation,

FIG. 3 a sectional side elevation as on line A-A of FIG. 1,

FIG. 4 an underneath plan view,

FIG. 5 an end elevation from the left, and

FIG. 6 an end elevation from the right, of a support or carrier for one typical form of disposable bedpan.

FIG. 7 is a plan view illustrating a support or carrier for an alternative form of disposable bedpan.

Referring to said drawings, and first to FIGS. 1 to 6, the bedpan support illustrated comprises a dished centre part defined by a substantially flat bottom 10, a generally outwardly inclined side wall 11 and an upper web 12 where from downwardly and outwardly extends a flange portion generally denoted by the reference numeral 13. The wall 11 is somewhat higher at the front (the left hand side as viewed in FIGS. 1–4) than the rear. The dished centre part corresponds in shape and is adapted to receive the receptacle portion of a disposable bedpan with the web 12 located below the flange or seat part of said bedpan, for example as shown at x in broken lines in FIG. 3.

It is to be noted that for the major part of its circumference said flange 13 is of a depth substantially less than said dished centre part of the support, e.g. it extends for only about half the depth of said dished centre part, but that at each side and rearwardly of the support's transverse centre line, i.e. to the right as viewed in FIGS. 1 to 4 of the drawings, said flange 13 is formed at each side with downwardly and outwardly extending wing portions 14 the extremities whereof are, on a level with or almost so, the bottom 10 of the dished centre part of the support. As can be seen clearly in FIGS. 5 and 6 said wing portions 14 extend for a substantial distance outwardly from the bottom 10. The wing portions 14 thus function as lateral support means which greatly increase the stability of the support in use. The peripheral edge of the flange 13 including the extensions 14 is formed with a flange or beading 16.

In order to obviate said wing portions 14 damaging bed linen upon which the support may be resting, the extremities thereof are substantially thickened as indicated at 15 thereby to provide relatively wide, smooth, non-abrasive bearing surfaces.

It will be seen that the particular design and shape of the flange 13 will facilitate manipulation of the support in that it can be safely gripped and held at substantially any point around its circumference, and this without or substantially without any lack of stability due to the laterally extending wing portions 14 provided at each side of the rearward half of the support, i.e., the part which in use sustains the greatest weight.

Referring to FIG. 7, in which like characters of reference are used to denote like or equivalent parts, the support illustrated has all the main features of the support described with reference to FIGS. 1 to 6, but is particularly intended for use with disposable bedpan inserts of the kind described in our prior patent application Ser. No. 400,508 of 1973. To this end, the web 12 thereof is shaped and configurated at each rearward side with a concavity 20 and at the rear a concavity 21, said concavities 20 merging smoothly into the concavity 21. These concavities 20, 21 are adapted to correspond with the characteristic shape of the seat portion of a bedpan insert as described in our said prior Patent application.

Non-expendable carriers or supports according to the invention may be composed of any material possessing sufficient strength and rigidity but preferably are moulded from a synthetic resin, e.g. polypropylene, incorporating a bacteriostat in order to impart inherent hygenic properties thereto. A suitable and highly effective bacteriostat is that obtainable under the Trade Name Irgasan DP 300.

What I claim as my invention and desire to secure by Letters Patent is:

1. A support for a disposable bedpan, comprising a dished center support portion defined by a substantially flat bottom, generally outwardly inclined side walls and an upper web wherefrom extends downwardly and outwardly a peripheral flange the major part of the circumference whereof extends for substantially less than the depth of said dished center part, said flange at each side and rearwardly of the transverse center line of the support being formed with downwardly and outwardly extending wing portions the extremities whereof are substantially on a level with said bottom of said dished center support portion, said extremities of said wing portions of the peripheral flange being substantially thickened to provide relatively wide non-abrasive bearing surfaces and a beading provided on the edge of said peripheral flange.

2. A support for a disposable bedpan, as claimed in claim 1 wherein said web at each side is formed with a concavity and at the rear is formed with a concavity, said concavities merging smoothly one with the other.

3. A support for a disposable bedpan, as claimed in claim 1 wherein said support is of a synthetic resin incorporating a bacteriostat.

4. A support for a disposable bedpan, as claimed in claim 3 wherein said bacteriostat is identified under the Trade Name Irgasan DP 300.

* * * * *